US010001331B2

(12) United States Patent
Couie

(10) Patent No.: US 10,001,331 B2
(45) Date of Patent: Jun. 19, 2018

(54) FIREARM MAGAZINE LOADER AND UNLOADER

(71) Applicant: William Christopher Couie, Vidalia, LA (US)

(72) Inventor: William Christopher Couie, Vidalia, LA (US)

( * ) Notice: Subject to any disclaimer, the term of this patent is extended or adjusted under 35 U.S.C. 154(b) by 0 days. days.

(21) Appl. No.: 15/440,984

(22) Filed: Feb. 23, 2017

(65) Prior Publication Data

US 2018/0080727 A1 Mar. 22, 2018

Related U.S. Application Data

(60) Provisional application No. 62/445,058, filed on Jan. 11, 2017, provisional application No. 62/396,643, filed on Sep. 19, 2016.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84
USPC ..... 42/87
See application file for complete search history.

(56) References Cited

U.S. PATENT DOCUMENTS

| | | | | |
|---|---|---|---|---|
| 4,538,371 | A | 9/1985 | Howard | |
| 4,570,371 | A | 2/1986 | Mears | |
| 4,993,180 | A * | 2/1991 | Upchurch | F41A 9/83 42/87 |
| 6,810,616 | B2 | 11/2004 | Tal et al. | |
| 6,817,134 | B2 | 11/2004 | Newman | |
| 7,257,919 | B1 * | 8/2007 | Farley | F41A 9/83 42/87 |
| 8,453,366 | B2 | 6/2013 | Gray | |
| 9,335,108 | B2 | 5/2016 | Cauley et al. | |
| 9,404,697 | B2 | 8/2016 | Cobb | |
| 9,599,416 | B2 * | 3/2017 | Slocum | F41A 9/83 |
| 2004/0020096 | A1 | 2/2004 | Tal et al. | |
| 2009/0044440 | A1 * | 2/2009 | Tal | F41A 9/84 42/87 |
| 2013/0192117 | A1 | 8/2013 | Meinel | |
| 2013/0232843 | A1 | 9/2013 | Bajuelo | |
| 2014/0298704 | A1 | 10/2014 | Niccum | |

* cited by examiner

*Primary Examiner* — Stephen Johnson
(74) *Attorney, Agent, or Firm* — Olav M. Underdal; IDP Patent Services

(57) ABSTRACT

A magazine loader/unloader includes a loader/unloader housing, including right and left sides, a front and rear connector members, and a bridge member; a loading structure, including a loading plunger, and a loading pusher; and an unloading structure, including top and bottom guides, and an unloading protrusion. Also disclosed is a method of using the magazine loader/unloader, including inserting round, loading round, and unloading round.

18 Claims, 8 Drawing Sheets

Magazine Loader/Unloader

Method of using the magazine loader/unloader

FIREARM MAGAZINE LOADER AND UNLOADER

CROSS-REFERENCE TO RELATED APPLICATIONS

This application claims the benefit of U.S. Provisional Application No. 62/445,058, filed Jan. 11, 2017 and of U.S. Provisional Application No. 62/396,643, filed Sep. 19, 2016.

FIELD OF THE INVENTION

The present invention relates generally to the field of firearm magazines, and more particularly to devices, methods and systems for loading and unloading a firearm magazine.

BACKGROUND OF THE INVENTION

Use of semi-automatic firearms require tedious and time consuming loading and unloading of magazines. Loading and unloading devices are available, but are generally complicated devices, which only are capable of either loading or unloading.

As such, considering the foregoing, it may be appreciated that there continues to be a need for novel and improved devices and methods for loading and unloading a firearm magazine.

SUMMARY OF THE INVENTION

The foregoing needs are met, to a great extent, by the present invention, wherein in aspects of this invention, enhancements are provided to the existing model of loading and unloading a firearm magazine.

In an aspect, a magazine loader/unloader, can include:

a) a loader/unloader housing, which is hollow and defines a housing interior, such that the loader/unloader housing accepts a top of a firearm magazine, via insertion of the firearm magazine through a bottom opening of the loader loader/unloader housing; and b) a loading structure, including:

a loading plunger, which is mounted on a bottom side of the bridge member, between the right and left sides;

wherein, when an ammunition round is inserted into an upper part of the interior below the loading plunger and the magazine loader/unloader is depressed downward: the loading plunger depresses the ammunition round downward into the firearm magazine, whereby the ammunition is seated within the firearm magazine.

In a related aspect, the magazine loader/unloader can further include a loading pusher, which is mounted behind and below the loading plunger, such that a front of the loading pusher protrudes at an inclination angle upward and inward from the rear connector member;

such that the loading pusher is configured to push the ammunition round forward in the firearm magazine, when the magazine loader/unloader is depressed downward.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
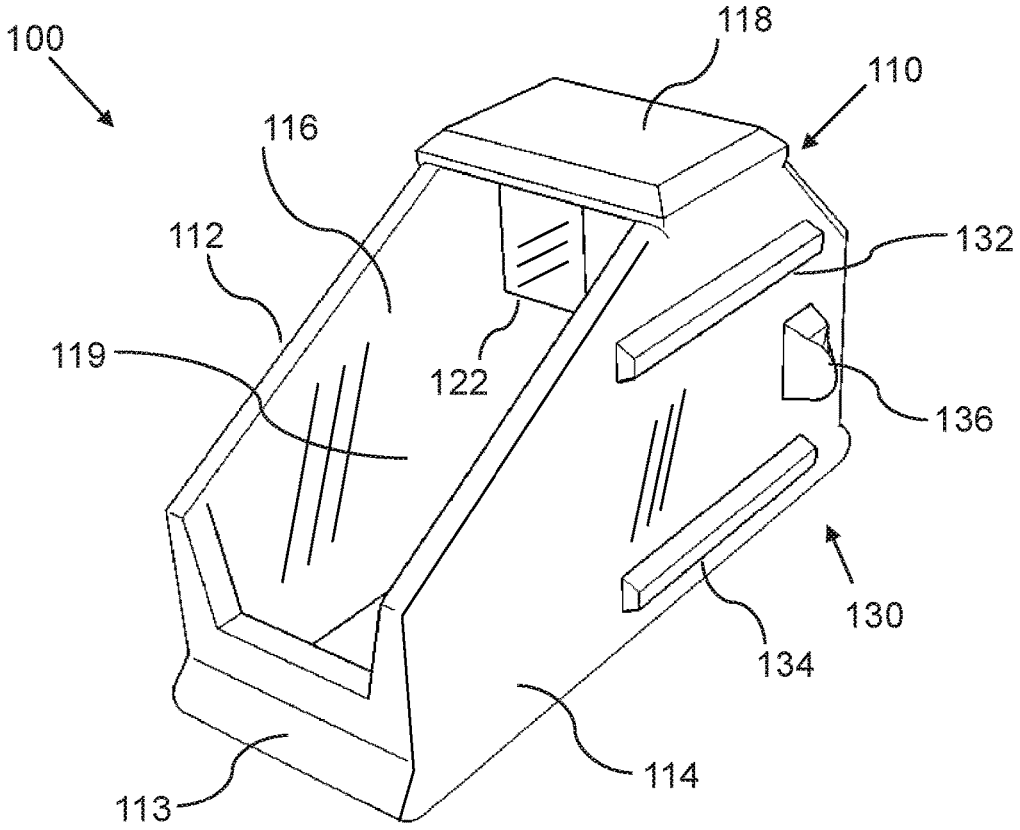
FIG. 1 is a perspective view of a magazine loader/unloader, according to an embodiment of the invention.
Figure 2:
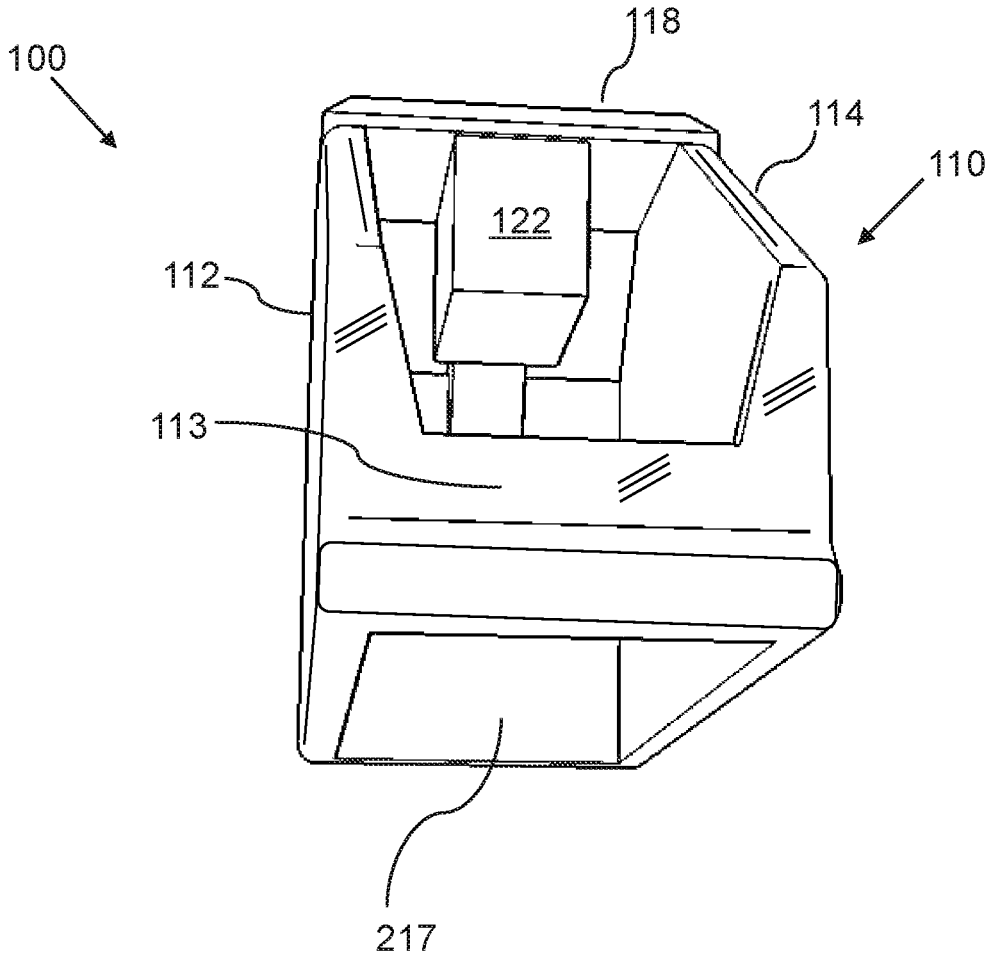
FIG. 2 is a front bottom perspective view of a magazine loader/unloader, according to an embodiment of the invention.

In the following, we describe the structure of an embodiment of a magazine loader/unloader 100 with reference to FIG. 1, in such manner that like reference numerals refer to like components throughout; a convention that we shall employ for the remainder of this specification.

Figure 3:
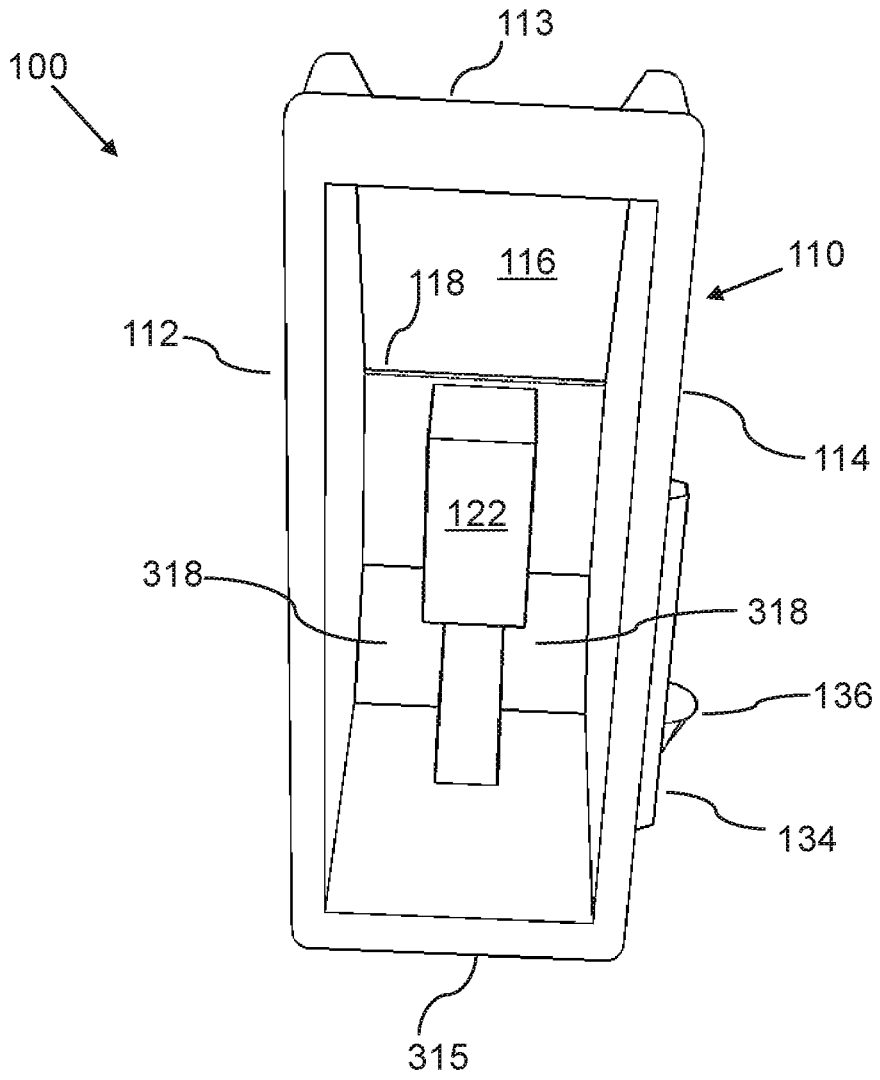
FIG. 3 is a bottom perspective view of a magazine loader/unloader, according to an embodiment of the invention.
Figure 4:
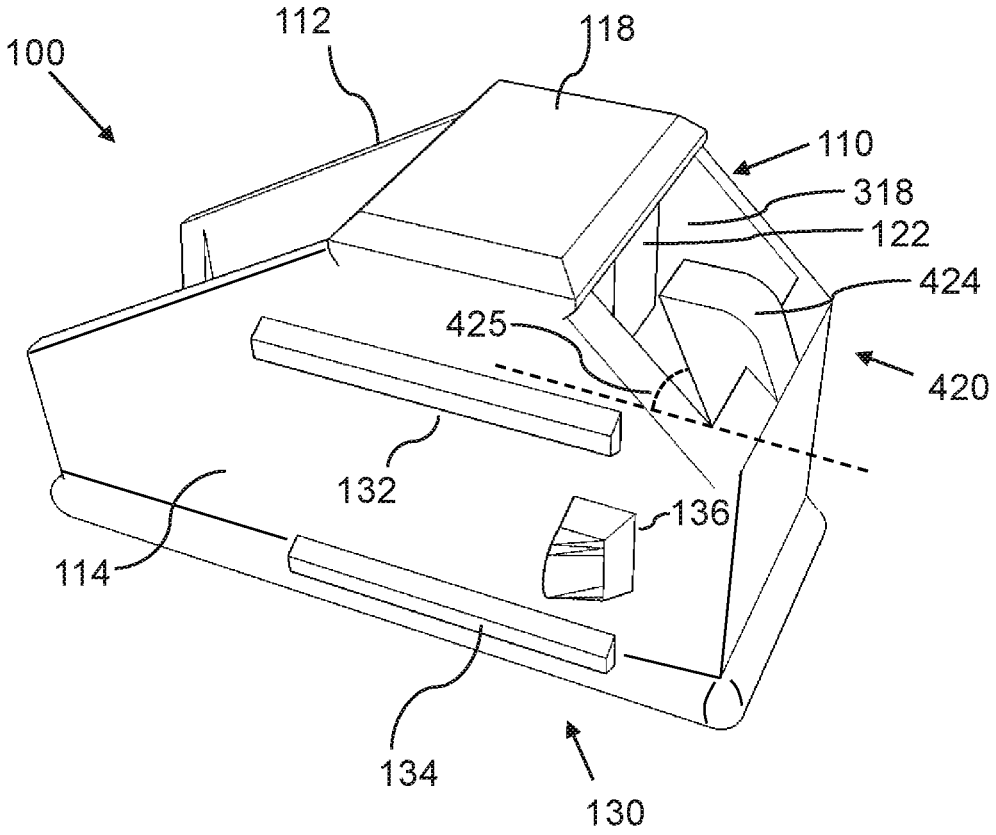
FIG. 4 is a rear side perspective view of a magazine loader/unloader, according to an embodiment of the invention.
Figure 5A:
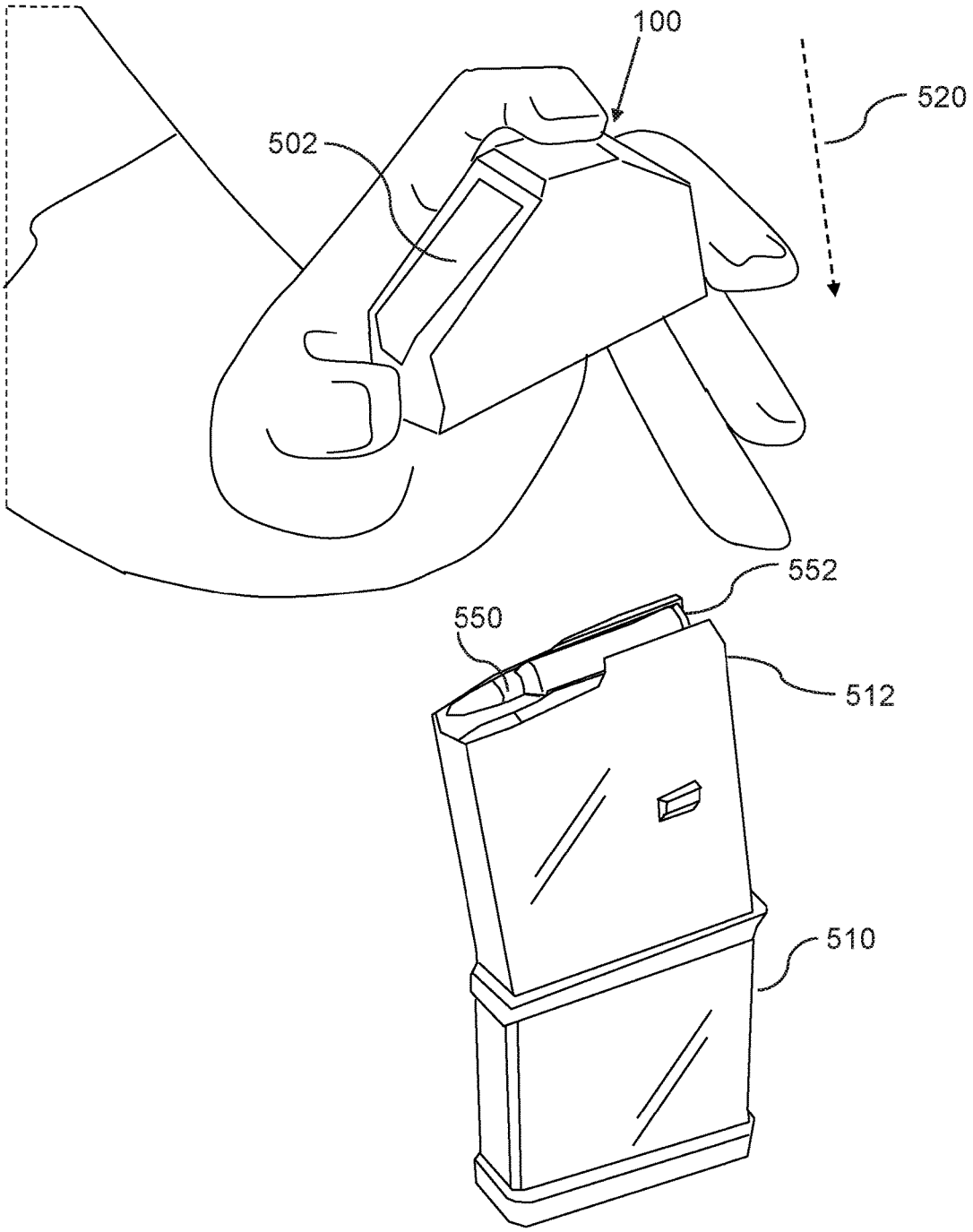
FIG. 5A is a perspective view of a magazine loader/unloader in use for loading a magazine, according to an embodiment of the invention.
Figure 5B:
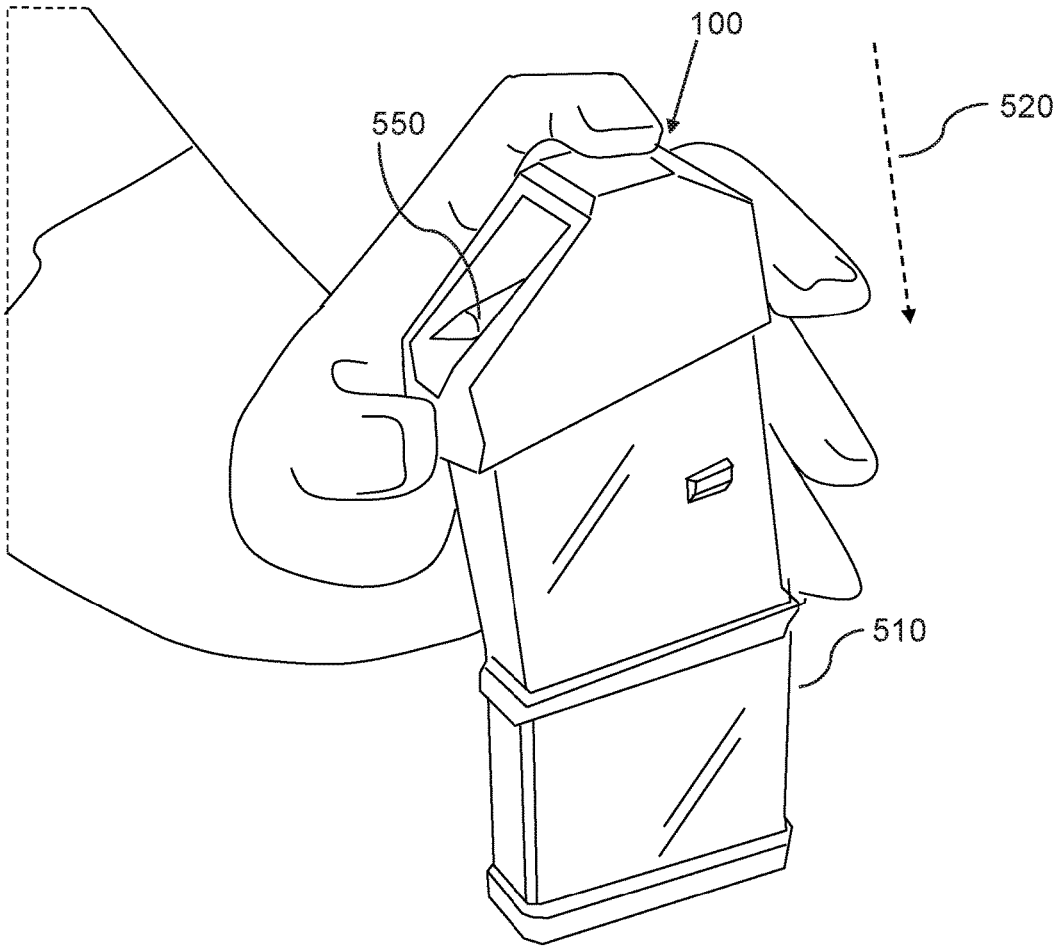
FIG. 5B is a perspective view of a magazine loader/unloader in use for loading a magazine, according to an embodiment of the invention.
Figure 6:
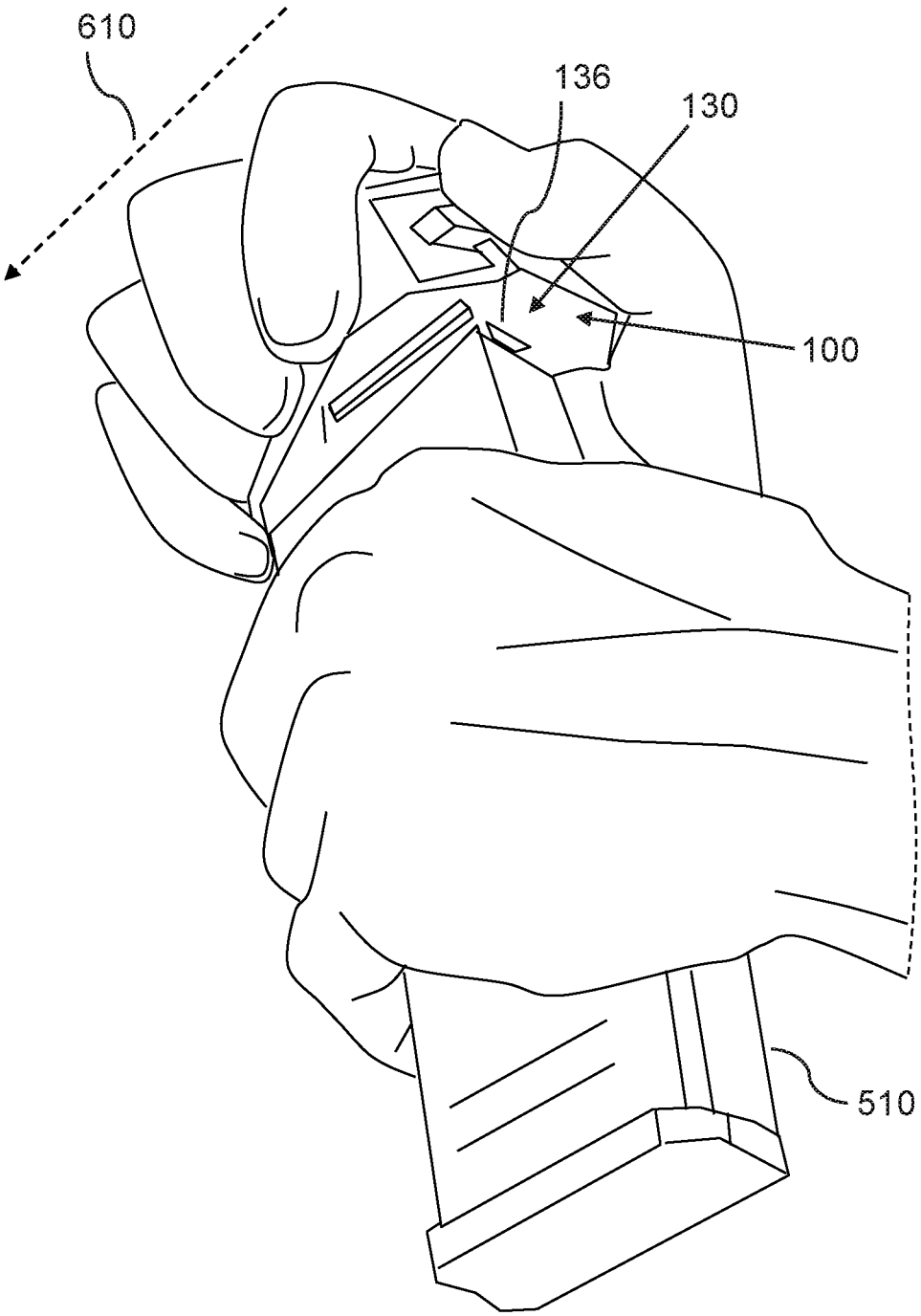
FIG. 6 is a perspective view of a magazine loader/unloader in use for unloading a magazine, according to an embodiment of the invention.
Figure 7:
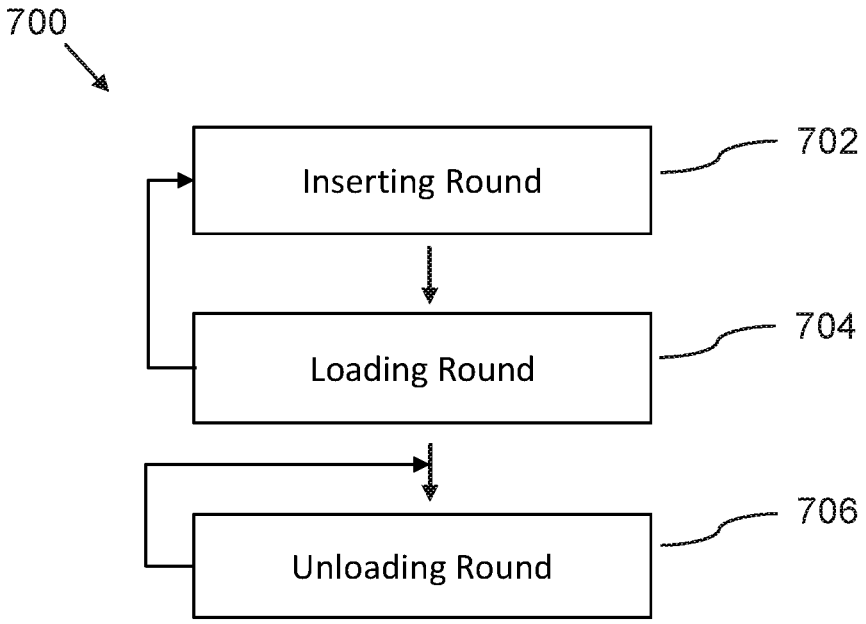
FIG. 7 is a flowchart illustrating steps that may be followed, in accordance with one embodiment of a method or process of using a magazine loader/unloader.

In an embodiment, as shown in FIGS. 1-4, a magazine loader/unloader 100 can include:

a) A loader/unloader housing 110, including:

i. right and left sides 112 114;

ii. a front connector member 113, which connects between front parts of the right and left sides 112 114;

iii. a rear connector member 315, as shown in FIG. 3, which connects between rear parts of the right and left sides 112 114; and iv. a bridge member 118, which connects between top parts of the right and left sides 112 114;

such that the loader/unloader housing 110 is hollow and defines a housing interior 119, which is accessible via a front upper opening 116, a rear upper opening 318, and a bottom opening 217;

such that the loader/unloader housing 110, as shown in FIG. 5B, is configured to accept an upper end 512 of a firearm magazine 510, via insertion of the firearm magazine 510 through the bottom opening 217;

b) A loading structure 420, including:

i. a loading plunger 122, which is mounted in an upper part 118 of the loader/unloader housing, such that the loading plunger protrudes downward into the housing interior, such that the loading plunger 122 can be mounted on a bottom side of the bridge member 118, between the right and left sides 112 114; and ii. a loading pusher 424, which is mounted behind and below the loading plunger, such that a front of the loading pusher 424 protrudes at an inclination angle 425 upward and inward from a rear 315 of the loader/unloader housing, which can be from the rear connector member 315;

wherein, as shown in FIG. 5B, when an ammunition round 550 is inserted into an upper part 502 of the housing interior 119 below the loading plunger and the magazine loader/unloader 100 is depressed downward 520 onto the upper end 512 of the firearm magazine 510, the loading plunger 122, depresses the ammunition round 550 downward into the firearm magazine 510, such that the loading pusher 424 pushes the ammunition round 550 forward in the firearm magazine 510, whereby the ammunition is seated within the firearm magazine 510;

c) An unloading structure 130, which is mounted on an outer side of the loader/unloader housing 110, which can be either an outer side of the right or left sides 112 114, the unloading structure 130 including:

i. A top guide 132;

ii. A bottom guide 134; and iii. An unloading protrusion 136;

wherein the bottom guide 134 is parallel to the top guide 132 and positioned below the top guide 132;

wherein, as shown in FIG. 6, when the unloading structure 130 is placed on the upper end 512 of the firearm magazine 510 such that the unloading protrusion 136 is positioned against a rear of the firearm magazine 510 and the magazine loader/unloader 100 is pushed forward: the unloading protrusion 136 engages with a rear end 552 of the ammunition round 550 and move the ammunition round 550 forward, such that the ammunition round 550 is ejected from the firearm magazine 510.

In a related embodiment, the inclination angle 425 can be in a range of 25 to 85 degrees.

In a related embodiment, the magazine loader/unloader 100 can be manufactured as one piece, for example by injection molding or by additive manufacturing, such as fused deposition modeling. Alternatively, the magazine loader/unloader 100 can be assembled from separate pieces that are for example glued or fused together. The magazine loader can be made of a plastic material, or other suitable materials, such as metal, including rubber or plastic coated metal.

In an embodiment, a method of using the magazine loader/unloader 700 can include:

a) Inserting round 702, wherein an ammunition round 550 is inserted while holding the magazine loader/unloader 100 partially inserted into a firearm magazine 510, such that the loading plunger 122 of the magazine loader/unloader 100 is positioned sufficiently high to allow the ammunition round 550 to be inserted inside the housing of the magazine loader/unloader 100;

b) Loading round 704, wherein the magazine loader/unloader 100 is depressed downward 520, such that the magazine loader/unloader 100 slides over the firearm magazine 510, such that the loading plunger 122 depresses the ammunition round 550 downward into the firearm magazine 510, such that the loading pusher 424 pushes the ammunition round 550 forward in the firearm magazine 510, whereby the ammunition is seated within the firearm magazine 510;

wherein the process of inserting round 702 and loading round 704 can be repeated until the firearm magazine 510 is full; and c) Unloading round 706, wherein the magazine loader/unloader 100 is held on a side that includes a unloading structure 130, and is placed on a top of the firearm magazine 510 such that the unloading protrusion 136 is positioned against a rear of the firearm magazine 510, such that the magazine loader/unloader 100 is pushed forward 610, such that the unloading protrusion 136 engages with a rear end of the ammunition round 550 and moves the ammunition round 550 forward, such that the ammunition round 550 is ejected from the firearm magazine 510;

wherein the bottom guide 134 is parallel to the top guide 132 and positioned below the top guide 132;

wherein the top and bottom guides 132 134 ensure a smooth forward sliding motion and ensures positioning of the unloading protrusion 136, such that the unloading protrusion 136 engages the ammunition round 550;

wherein the firearm magazine 510 can be emptied by sliding the magazine loader/unloader 100 back to the original position and repeating unload round 706 until the firearm magazine 510 is unloaded to a desired level, such as for example completely unloaded.

Here has thus been described a multitude of embodiments of the magazine loader/unloader 100 and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A magazine loader/unloader, comprising:

a) a loader/unloader housing, which is hollow and defines a housing interior, such that the loader/unloader housing is configured to accept an upper end of a firearm magazine, via insertion of the firearm magazine through a bottom opening of the loader/unloader housing; and b) a loading structure, comprising:

a loading plunger, which is mounted in an upper part of the loader/unloader housing, such that the loading plunger protrudes into the housing interior; and a loading pusher, which is mounted behind and below the loading plunger, such that a front of the loading pusher protrudes at an inclination angle upward and inward from a rear of the loader/unloader housing;

wherein, when an ammunition round is inserted into an upper part of the housing interior below the loading plunger and the magazine loader/unloader is depressed downward onto the upper end of the firearm magazine, the loading plunger is configured to depress the ammunition round downward into the firearm magazine, such that the loading pusher is configured to push the ammunition round forward in the firearm magazine, when the magazine loader/unloader is depressed downward, whereby the ammunition is seated within the firearm magazine.

2. The magazine loader/unloader of claim 1, wherein the loader/unloader housing further comprises:

a) right and left sides; and b) a bridge member, which connects between top parts of the right and left sides;

wherein the loading plunger is mounted on a bottom side of the bridge member, between the right and left sides.

3. The magazine loader/unloader of claim 2, wherein the loader/unloader housing further comprises:

a) a front connector member, which connects between front parts of the right and left sides;

b) a rear connector member, which connects between rear parts of the right and left sides;

such that the housing interior is configured to be accessible via a front upper opening, a rear upper opening, and the bottom opening;

wherein the loading pusher is connected to the rear connector member.

4. The magazine loader/unloader of claim 1, further comprising:

an unloading structure, which is mounted on an outer side of the loader/unloader housing, the unloading structure comprising:

an unloading protrusion;

wherein, when the unloading structure is placed on a top of the firearm magazine, such that the unloading protrusion is positioned against a rear of the firearm magazine and the magazine loader/unloader is pushed forward, the unloading protrusion is configured to engage with a rear end of the ammunition round and move the ammunition round forward, such that the ammunition round is ejected from the firearm magazine.

5. The magazine loader/unloader of claim 4, wherein the unloading structure further comprises:

a) a top guide; and b) a bottom guide;

wherein the bottom guide is parallel to the top guide and positioned below the top guide;

such that the top and bottom guides are configured to ensure a smooth forward sliding motion and ensure positioning of the unloading protrusion, such that the unloading protrusion engages the ammunition round.

6. The magazine loader/unloader of claim 1, wherein the magazine loader/unloader is manufactured in one piece.

7. The magazine loader/unloader of claim 1, wherein the magazine loader/unloader is manufactured of a plastic material.

8. A method of using a magazine loader/unloader, comprising:

a) inserting round, wherein an ammunition round is inserted while holding a magazine loader/unloader partially inserted into a firearm magazine, such that a loading plunger of the magazine loader/unloader is positioned to allow the ammunition round to be inserted inside a loader/unloader housing of the magazine loader/unloader;

b) loading round, wherein the magazine loader/unloader is depressed downward, such that the magazine loader/unloader slides over the magazine, such that the loading plunger depresses the ammunition round downward into the firearm magazine, such that a loading pusher depresses the ammunition round forward in the firearm magazine, whereby the ammunition is seated within the firearm magazine;

wherein the magazine loader/unloader comprises:

the loader/unloader housing, which is hollow and defines a housing interior, such that the loader/unloader housing is configured to accept an upper end of the firearm magazine, via insertion of the firearm magazine through a bottom opening of the loader/unloader housing; and a loading structure, comprising:

the loading plunger, which is mounted in an upper part of the loader/unloader housing, such that the loading plunger protrudes into the housing interior; and the loading pusher, which is mounted behind and below the loading plunger, such that a front of the loading pusher protrudes at an inclination angle upward and inward from a rear of the loader/unloader housing;

wherein, when an ammunition round is inserted into an upper part of the interior below the loading plunger and the magazine loader/unloader is depressed downward, the loading plunger is configured to depress the ammunition round downward into the firearm magazine, such that the loading pusher is configured to push the ammunition round forward in the firearm magazine, when the magazine loader/unloader is depressed downward, whereby the ammunition is seated within the firearm magazine.

9. The method of using a magazine loader/unloader of claim 8, further comprising:

unloading round, wherein the magazine loader/unloader is held on a side that includes an unloading structure with an unloading protrusion, such that the unloading structure is placed on a top of the firearm magazine, such that the unloading protrusion is positioned against a rear of the firearm magazine, such that the magazine loader/unloader is pushed forward, such that the unloading protrusion engages with a rear end of the ammunition round and moves the ammunition round forward, such that the ammunition round is ejected from the firearm magazine;

wherein the loader/unloader further comprises:

the unloading structure, which is mounted on an outer side of the loader/unloader housing, the unloading structure comprising:

the unloading protrusion.

10. The method of using a magazine loader/unloader of claim 9, wherein the unloading structure further comprises:

c) a top guide; and d) a bottom guide;

wherein the bottom guide is parallel to the top guide and positioned below the top guide;

such that the top and bottom guides are configured to ensure a smooth forward sliding motion and ensure positioning of the unloading protrusion, such that the unloading protrusion engages the ammunition round.

11. The method of using a magazine loader/unloader of claim 8, wherein the loader/unloader housing further comprises:

a) right and left sides; and b) a bridge member, which connects between top parts of the right and left sides;

wherein the loading plunger is mounted on a bottom side of the bridge member, between the right and left sides.

12. The method of using a magazine loader/unloader of claim 11, wherein the loader/unloader housing further comprises:

a) a front connector member, which connects between front parts of the right and left sides;

b) a rear connector member, which connects between rear parts of the right and left sides;

such that the housing interior is configured to be accessible via a front upper opening, a rear upper opening, and the bottom opening.

13. The method of using a magazine loader/unloader of claim 8, wherein the magazine loader/unloader is manufactured in one piece.

14. The method of using a magazine loader/unloader of claim 8, wherein the magazine loader/unloader is manufactured of a plastic material.

15. A magazine loader/unloader, comprising:

a) a loader/unloader housing, which is hollow and defines a housing interior, such that the loader/unloader housing is configured to accept an upper end of a firearm magazine, via insertion of the firearm magazine through a bottom opening of the loader/unloader housing;

b) a loading structure, comprising:

a loading plunger, which is mounted in an upper part of the loader/unloader housing, such that the loading plunger protrudes into the housing interior; and c) an unloading structure, which is mounted on an outer side of the loader/unloader housing, the unloading structure comprising:

an unloading protrusion;

wherein, when the unloading structure is placed on a top of the firearm magazine, such that the unloading protrusion is positioned against a rear of the firearm magazine and the magazine loader/unloader is pushed forward, the unloading protrusion is configured to engage with a rear end of the ammunition round and move the ammunition round forward, such that the ammunition round is ejected from the firearm magazine; and wherein, when an ammunition round is inserted into an upper part of the housing interior below the loading plunger and the magazine loader/unloader is depressed downward onto the upper end of the firearm magazine, the loading plunger is configured to depress the ammunition round downward into the firearm magazine, whereby the ammunition is seated within the firearm magazine.

16. The magazine loader/unloader of claim 15, wherein the unloading structure further comprises:

a) a top guide; and b) a bottom guide;

wherein the bottom guide is parallel to the top guide and positioned below the top guide;

such that the top and bottom guides are configured to ensure a smooth forward sliding motion and ensure positioning of the unloading protrusion, such that the unloading protrusion engages the ammunition round.

17. The magazine loader/unloader of claim 15, wherein the loading structure further comprises:

a loading pusher, which is mounted behind and below the loading plunger, such that a front of the loading pusher protrudes at an inclination angle upward and inward from a rear of the loader/unloader housing;

such that the loading pusher is configured to push the ammunition round forward in the firearm magazine, when the magazine loader/unloader is depressed downward.

18. The magazine loader/unloader of claim 17, wherein the loader/unloader housing further comprises:

c) a front connector member, which connects between front parts of the right and left sides;

d) a rear connector member, which connects between rear parts of the right and left sides;

such that the housing interior is configured to be accessible via a front upper opening, a rear upper opening, and the bottom opening;

wherein the loading pusher is connected to the rear connector member.

* * * * *